US008133038B2

(12) United States Patent
Kwon et al.

(10) Patent No.: US 8,133,038 B2
(45) **Date of Patent: *Mar. 13, 2012**

(54) HERMETIC COMPRESSOR

(75) Inventors: Dae Il Kwon, Gwangju (KR); Min Cheul Yun, Gwangju (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 539 days.

This patent is subject to a terminal disclaimer.

(21) Appl. No.: 12/346,163

(22) Filed: Dec. 30, 2008

(65) Prior Publication Data

US 2010/0166586 A1 Jul. 1, 2010

(51) Int. Cl.
*F04B 39/00* (2006.01)
*F04B 53/00* (2006.01)

(52) U.S. Cl. ..... 417/312; 181/403

(58) Field of Classification Search ..... 417/312, 417/415, 900; 181/403
See application file for complete search history.

(56) References Cited

U.S. PATENT DOCUMENTS 2,407,276 A * 9/1946 Hendel et al. ..... 138/26
4,299,253 A * 11/1981 Burton ..... 138/30
4,450,904 A * 5/1984 Volz ..... 165/162
4,836,330 A * 6/1989 Harwood et al. ..... 181/282
5,961,309 A * 10/1999 Harpole et al. ..... 418/181
7,029,242 B2 * 4/2006 Jay et al. ..... 417/312
2002/0071774 A1 * 6/2002 Lee ..... 417/312
2005/0042114 A1 * 2/2005 Seo et al. ..... 417/312
2005/0106038 A1 * 5/2005 Yoon et al. ..... 417/312
2008/0145242 A1 * 6/2008 Seibel et al. ..... 417/312
2009/0028725 A1 * 1/2009 Park et al. ..... 417/312
2010/0310389 A1 * 12/2010 Alvarenga ..... 417/312

FOREIGN PATENT DOCUMENTS

KR 10-2006-0024717 A 3/2006

* cited by examiner

*Primary Examiner* — Devon C Kramer
*Assistant Examiner* — Christopher Maxey
(74) *Attorney, Agent, or Firm* — Blank Rome LLP

(57) ABSTRACT

A hermetic compressor having a frame, a cylinder provided at one side of the frame and having a compression chamber, a cylinder head coupled to the cylinder so as configured to hermetically seal the compression chamber and having a refrigerant discharge chamber to receive a refrigerant discharged from the compression chamber, a damping discharge chamber provided at the other side of the frame, a discharge guide path formed in the frame connecting the refrigerant discharge chamber and the damping discharge chamber, a discharge pipe having an entrance end connected to the damping discharge chamber, and an extension tube provided in the damping discharge chamber. The extension tube has an entrance end connected to an exit end of the discharge guide path, an exit end being spaced apart from an entrance end of the discharge pipe.

12 Claims, 5 Drawing Sheets

HERMETIC COMPRESSOR

CROSS-REFERENCE TO RELATED APPLICATION

This application claims the benefit of Korean Patent Application No. 2007-0094362, filed on Sep. 17, 2007 in the Korean Intellectual Property Office, the disclosure of which is incorporated herein by reference.

FIELD OF THE INVENTION

The present invention relates to a hermetic compressor, and, more particularly, to a hermetic compressor having an improved refrigerant discharge path to efficiently reduce pulsation of a refrigerant to be discharged.

BACKGROUND OF THE INVENTION

In general, a hermetic compressor is employed in a refrigeration cycle of a refrigerator, air conditioner, etc., to compress a refrigerant. The hermetic compressor includes a hermetic container defining an external appearance thereof. The hermetic container includes, at opposite sides thereof, a suction pipe to guide a refrigerant, which has passed through an evaporator of the refrigeration cycle, into the hermetic container, and a discharge pipe to guide the refrigerant, compressed within the hermetic container, to a condenser of the refrigeration cycle outside of the hermetic container.

The hermetic container includes a drive unit to provide a drive force for compression of the refrigerant, and a compression unit to compress the refrigerant upon receiving the drive force of the drive unit. Both the drive unit and the compression unit are installed, via a frame, in the hermetic container.

The compression unit includes a cylinder provided at one side of the frame. The cylinder has a compression chamber, a piston to rectilinearly reciprocate in the compression chamber via the drive force of the drive unit, and a cylinder head coupled to the cylinder so as to hermetically seal the compression chamber, the cylinder head having a refrigerant suction chamber and a refrigerant discharge chamber which are separated from each other. A valve device is typically interposed between the cylinder and the cylinder head to control the flow of refrigerant to be suctioned from the refrigerant suction chamber into the compression chamber or to be discharged from the compression chamber into the refrigerant discharge chamber. The refrigerant suction chamber is connected to the suction pipe, and the refrigerant discharge chamber is connected to the discharge pipe.

With the above-described configuration, when the piston rectilinearly reciprocates in the compression chamber via operation of the drive unit, a pressure difference occurs between the interior and the exterior of the compression chamber, causing the refrigerant, guided into the hermetic container along the suction pipe, to be introduced into the refrigerant suction chamber, and subsequently, to be suctioned into and compressed in the compression chamber. The compressed refrigerant is discharged from the compression chamber to the outside of the hermetic container through the refrigerant discharge chamber and the discharge pipe. As this operation is repeatedly carried out, the compressor carries out compression of the refrigerant.

In addition, the hermetic compressor includes a damping discharge chamber to reduce pressure pulsation of the refrigerant having passed through the refrigerant discharge chamber, so as to reduce pulsation noise of the refrigerant. The damping discharge chamber defines a predetermined expansion space. Accordingly, the discharge pipe guides the refrigerant, which is reduced in noise while passing through the damping discharge chamber, to the outside of the hermetic container.

FIG. 1 illustrates a prior art damping discharge chamber 1 provided in a hermetic compressor. As shown in FIG. 1, the damping discharge chamber 1 includes a chamber space 2*a* formed in a frame 2 to have an open end, and a cover 3 coupled to the frame 2 to cover the open end of the chamber space 2*a*. The refrigerant discharge chamber (not shown) is connected to the damping discharge chamber 1 via a discharge guide path 2*b* formed in the frame 2. An entrance end of a discharge pipe 4 is connected to the cover 3.

The refrigerant, having passed through the refrigerant discharge chamber is guided into the damping discharge chamber 1 through the discharge guide path 2*b*. The refrigerant is diffused in the damping discharge chamber 1, whereby the refrigerant, having reduced pulsation noise, is discharged to outside of the hermetic container via the discharge pipe 4.

When the discharge guide path 2*b* is long, a flow distance of the refrigerant increases. It is thus possible, for example, to intercept a high-order frequency in pulsation of the refrigerant, resulting in more efficient reduction of refrigerant pulsation.

Accordingly, in recent years, an effort to maximize the length of the discharge guide path 2*b* formed in the frame 2 has been made. However, due to the fact that the frame 2 is conventionally formed by casting and has a high strength, forming the discharge guide path 2*b* of the frame 2 requires a difficult operation to provide a hole in the high-strength frame 2. Therefore, lengthening the discharge guide path 2*b* of the frame 2 of the prior art hermetic compressor is difficult.

SUMMARY OF THE INVENTION

Accordingly, it is an aspect of the invention to provide a hermetic compressor having an improved refrigerant discharge path to more efficiently reduce pulsation of a refrigerant to be discharged.

Additional aspects and/or advantages of the invention will be set forth in part in the description which follows and, in part, will be obvious from the description, or may be learned by practice of the invention.

In accordance with the invention, the above and/or other aspects can be achieved by providing a hermetic compressor having an improved refrigerant discharge path to efficiently reduce pulsation of a refrigerant to be discharged. The hermetic compressor includes a frame, a cylinder provided at one side of the frame and having a compression chamber, a cylinder head coupled to the cylinder so as configured to hermetically seal the compression chamber and having a refrigerant discharge chamber to receive a refrigerant discharged from the compression chamber, a damping discharge chamber provided at the other side of the frame configured to reduce pressure pulsation of the refrigerant having passed through the refrigerant discharge chamber, a discharge guide path formed in the frame connecting the refrigerant discharge chamber and the damping discharge chamber, a discharge pipe having an entrance end connected to the damping discharge chamber so as to guide the refrigerant, having passed through the damping discharge chamber, to outside of the hermetic compressor, and an extension tube provided in the damping discharge chamber. The extension tube has an entrance end connected to an exit end of the discharge guide path, an exit end being spaced apart from an entrance end of the discharge pipe, and at least a portion of the extension tube being bendable.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
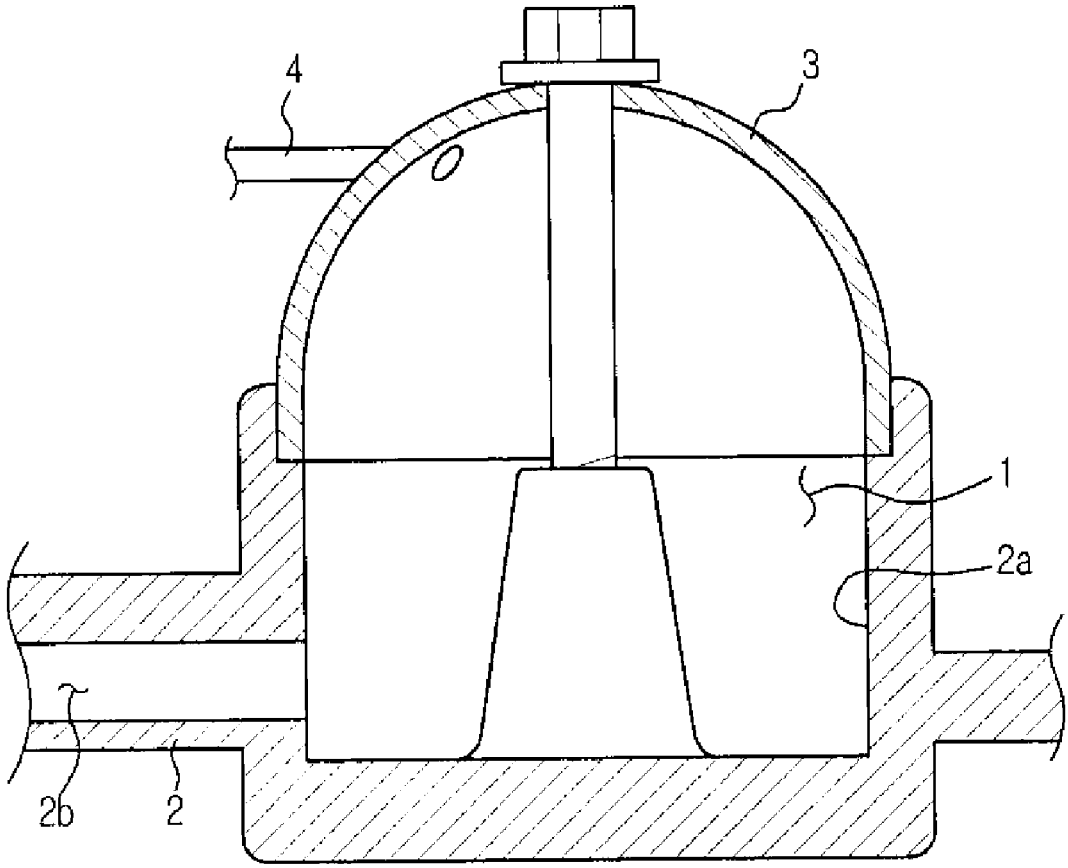
FIG. 1 (Prior Art)
FIG. 1 is a sectional elevational view illustrating a prior art damping discharge chamber provided in a hermetic compressor.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Figure 2:
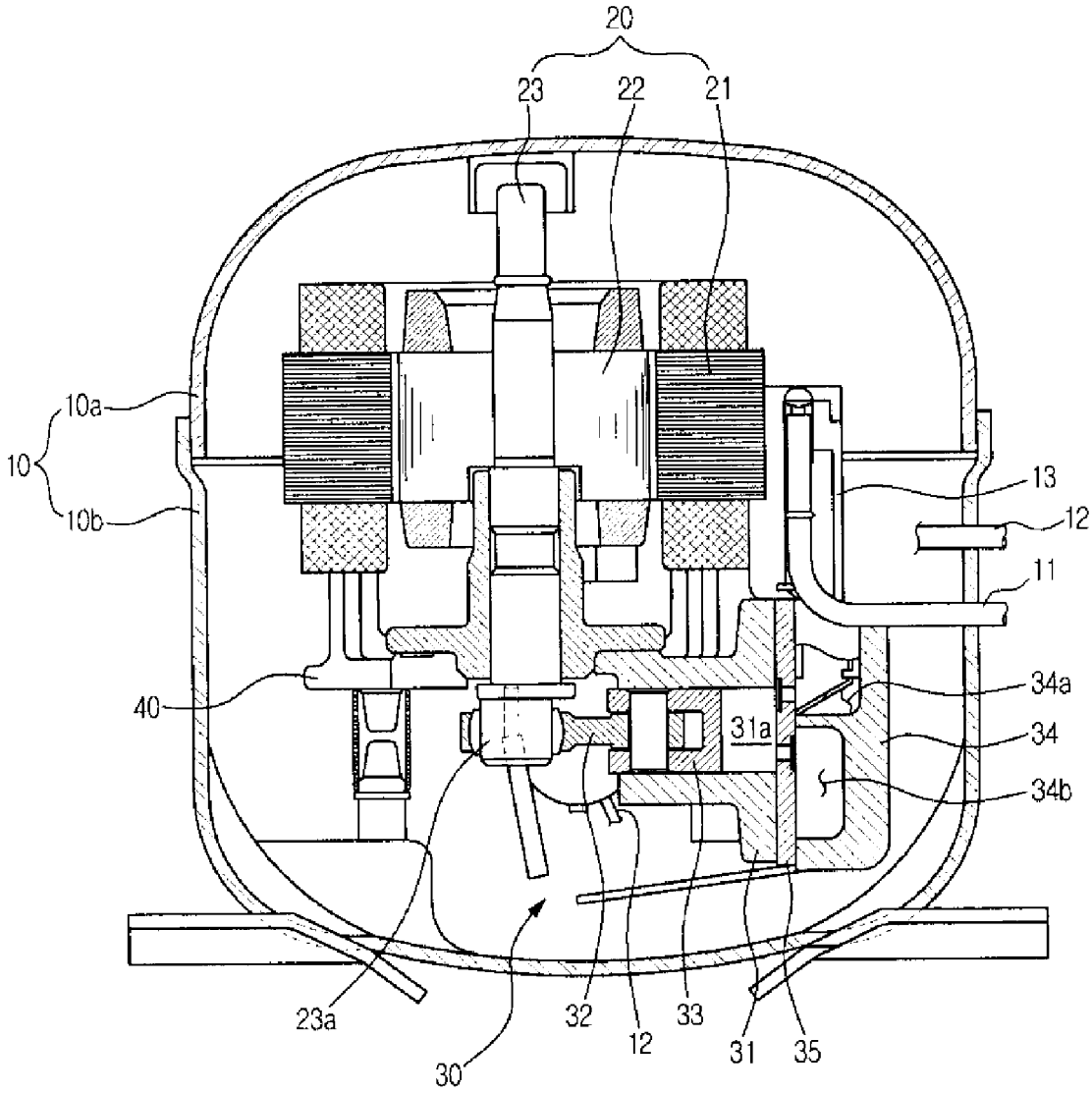
FIG. 2 is a sectional elevational view schematically illustrating the overall configuration of a hermetic compressor in accordance with an exemplary embodiment of the present invention.

FIG. 2 illustrates the overall configuration of a hermetic compressor in accordance with a preferred embodiment of the present invention. The hermetic compressor includes a hermetic container 10 defining an external appearance of the hermetic compressor. The hermetic container 10 may include an upper container 10*a* and a lower container 10*b*, which are coupled to each other. The hermetic container 10 may be provided, at one side thereof, with a suction pipe 11 to guide a refrigerant, having passed through an evaporator of a refrigeration cycle, into the hermetic container 10, and, at the other side thereof, with a discharge pipe 12 to guide the refrigerant, compressed within the hermetic container 10, to a condenser of the refrigeration cycle at the outside of the hermetic container 10.

The hermetic container 10 may include a drive unit 20 to provide a drive force for compression of the refrigerant, and a compression unit 30 to compress the refrigerant upon receiving the drive force of the drive unit 20. Both the drive unit 20 and the compression unit 30 are installed in the hermetic container 10 via a frame 40 that is conventionally formed by casting.

The drive unit 20 may include a stator 21 installed around an upper portion of the frame 40, a rotor 22 rotatably installed inside the stator 21 to rotate via electromagnetic interaction with the stator 21, and a rotating shaft 23 press-fitted in the center of the rotor 22 to rotate together with the rotor 22.

A portion of the rotating shaft 23 below the rotor 22 rotatably penetrates through the center of the frame 40, to protrude downward from the frame 40. An eccentric shaft portion 23*a* may be integrally formed at a lower end of the rotating shaft 23, to eccentrically rotate.

The compression unit 30 may include a cylinder 31 integrally formed with one side of the frame 40. The cylinder 31 may also be formed separately from the frame 40. The cylinder 31 may have a compression chamber 31*a*, a piston 33 connected with the eccentric shaft portion 23*a* via a connecting rod 32 to rectilinearly reciprocate in the compression chamber 31*a* upon receiving the drive force of the drive unit 20, and a cylinder head 34 coupled to one end of the cylinder 31 so as to hermetically seal the compression chamber 31*a*. The cylinder head 34 may have a refrigerant suction chamber 34*a* and a refrigerant discharge chamber 34*b* which are separated from each other. The cylinder 31 may also include a valve device 35 interposed between the cylinder 31 and the cylinder head 34 to control the flow of refrigerant to be suctioned from the refrigerant suction chamber 34*a* into the compression chamber 31*a* or to be discharged from the compression chamber 31*a* into the refrigerant discharge chamber 34*b*. The refrigerant suction chamber 34*a* may be connected with the suction pipe 11, and the refrigerant discharge chamber 34*b* may be connected with the discharge pipe 12.

With the above-described configuration, when the piston 33 rectilinearly reciprocates in the compression chamber 31*a* via operation of the drive unit 20, a pressure difference occurs between the interior and the exterior of the compression chamber 31*a*, causing the refrigerant, guided into the hermetic container 10 along the suction pipe 11, to be suctioned, by way of the refrigerant suction chamber 34*a*, into and compressed in the compression chamber 31*a*. The compressed refrigerant is discharged from the compression chamber 31*a* to the outside of the hermetic container 10 through the refrigerant discharge chamber 34*b* and the discharge pipe 12 so as to be supplied to a condenser of the refrigeration cycle.

The hermetic container 10 may further include a suction muffler 13, which reduces pressure pulsation of the refrigerant supplied into the hermetic container 10 along the suction pipe 11, thereby reducing the noise of the suctioned refrigerant.

To further reduce pressure pulsation of the refrigerant that has passed through the refrigerant discharge chamber 34*b*, a damping discharge chamber 50 is provided in the frame 40 at one side of the cylinder 31, to define a predetermined expansion space. Accordingly, the discharge pipe 12 guides the refrigerant, which is reduced in noise while passing through the damping discharge chamber 50, to the outside of the hermetic container 10.

Figure 3:
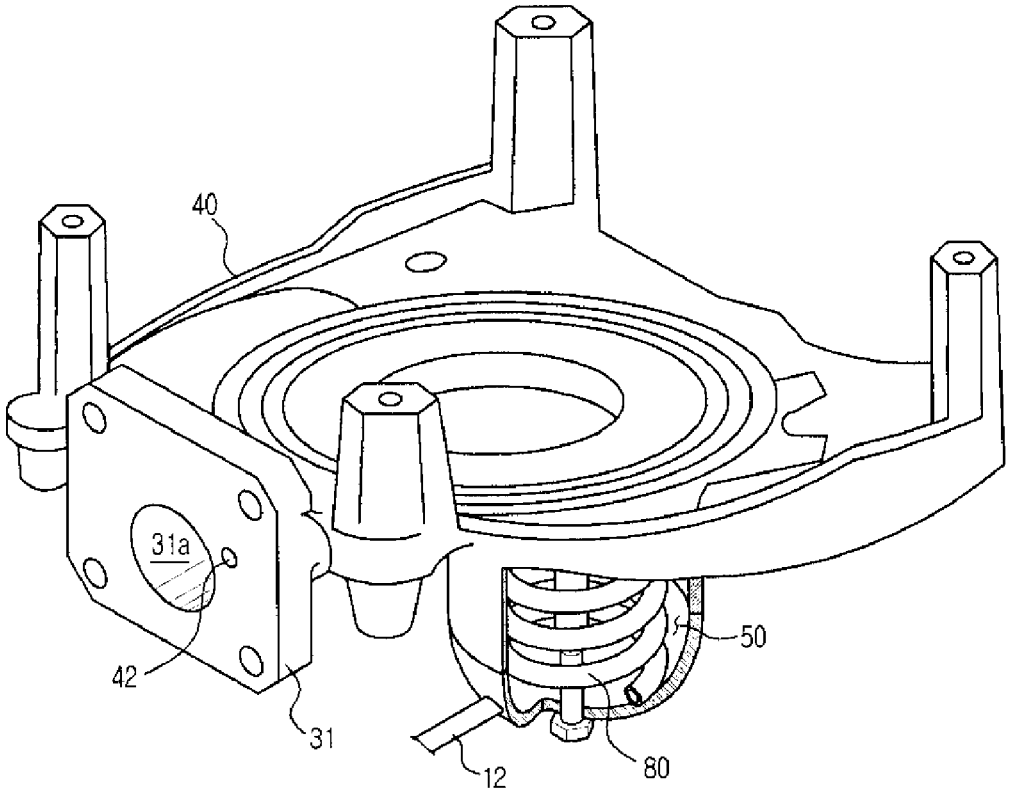
FIG. 3 is a perspective view illustrating a frame and a damping discharge chamber in the hermetic compressor in accordance with an exemplary embodiment of the present invention.
Figure 4:
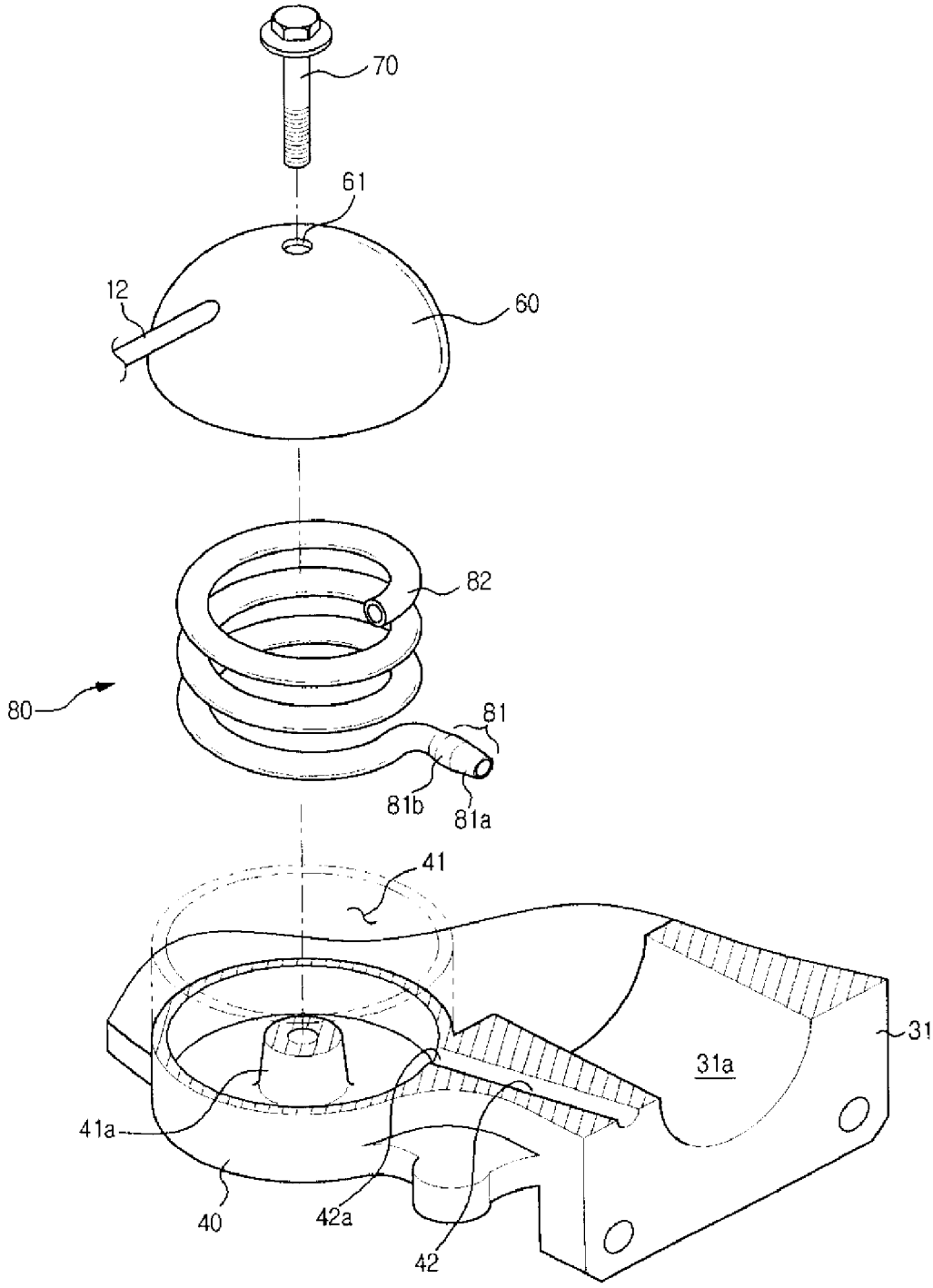
FIG. 4 is an exploded perspective view illustrating the damping discharge chamber of the hermetic compressor in accordance with an exemplary embodiment of the present invention.

As shown in FIGS. 3 and 4, the damping discharge chamber 50 may include a cup 41 formed in a lower portion of the frame 40 at one side of the cylinder 31, and a cover 60 to cover an open end of the cup 41. The space inside the cup 41 and the cover 60 defines the space of the damping discharge chamber 50.

A threaded boss 41*a* is formed at a bottom surface of the cup 41. A bolt fastening hole 61 is perforated in the center of the cover 60. As a fixing bolt 70 is fastened to the boss 41*a* through the bolt fastening hole 61, the cover 60 hermetically seals the cup 41, to complete the damping discharge chamber 50.

The refrigerant discharge chamber 34*b* is preferably connected with the damping discharge chamber 50 through a discharge guide path 42 formed in the frame 40. An entrance end of the discharge pipe 12 is connected to the cover 60. Accordingly, the refrigerant, having passed through the refrigerant discharge chamber 34*b*, is diffused into the damping discharge chamber 50 by way of the discharge guide path 42, whereby the refrigerant, having reduced pulsation noise, is delivered to the outside of the hermetic container 10 along the discharge pipe 12.

When the discharge guide path 42 is long, a flow distance of the refrigerant increases. It is thus possible, for example, to intercept a high-order frequency in pulsation of the refrigerant, resulting in efficient reduction of refrigerant pulsation. To achieve lengthening of the discharge guide path 42, in the present invention, an extension tube 80 may be installed in the damping discharge chamber 50 such that an entrance end 81 thereof may be connected to an exit end 42*a* of the discharge guide path 42 and an exit end 82 thereof may be spaced apart from an entrance end 12*a* of the discharge tube 12.

When the extension tube 80 is provided, the refrigerant, having passed through the discharge guide path 42, is diffused into the damping discharge chamber 50 after passing throughout the extension tube 80 installed in the discharge chamber 50. As a result, the refrigerant, guided from the refrigerant discharge chamber 34*b* to the damping discharge chamber 50, has a long flow distance, achieving more efficient pulsation reduction than the prior art damping discharge chamber in FIG. 1.

With the use of the extension tube 80, the refrigerant guided into the damping discharge chamber 50 can achieve a long flow distance, without requiring the discharge guide path 42 in the frame 40 to be long. The use of the extension tube 80 further has several advantages, for example, of eliminating a separate installation space for the extension tube 80.

The extension tube 80 may be a thin metal tube made of, for example, aluminum. The entrance end 81 of the extension tube 80, connected to the exit end 42*a* of the discharge guide path 42, may include a tapered guide portion 81*a* to guide insertion of the entrance end 81 into the exit end 42*a* of the discharge guide path 42, and a press-fitting portion 81*b* to be forcibly press-fitted to an inner diameter surface of the exit end 42*a*. The guide portion 81*a* and press-fitting portion 81*b* may be formed successively. Accordingly, in a state wherein the entrance end 81 of the extension tube 80 is coupled to the exit end 42*a* of the discharge guide path 42, an outer-diameter surface of the press-fitting portion 81*b* of the extension tube 80 may come into close contact with the inner-diameter surface of the exit end 42*a* of the discharge guide path 42, preventing leakage of the refrigerant from a gap between the extension tube 80 and the discharge guide path 42.

To maximize the flow distance of the refrigerant in the damping discharge chamber 50, at least a partial section of the discharge tube 80 may be bent. In the present embodiment, the extension tube 80 may be bent to have a general coil form suitable to achieve maximum space utilization in the discharge chamber 50. The resulting coiled extension tube 80 surrounds the boss 41*a* and the fixing bolt 70 located in the center of the damping discharge chamber 50.

The exit end 82 of the extension tube 80 may be spaced apart from the entrance end 12*a* of the discharge pipe 12 connected to the cover 60, to allow the refrigerant, guided along the extension tube 80, to be diffused into the discharge chamber 50. However, due to the fact that the exit end 82 of the extension tube 80 may not be supported at a fixed position in the damping discharge chamber 50, there is a risk of excessive movement of the extension tube 80 during guidance of the refrigerant. As a result, the extension tube 80 may collide with an inner surface of the cover 60 or the cup 41, generating collision noise. To prevent such a problem, the extension tube 80 is preferably arranged in such a way that it can be pushed by the cover 60 in the course of coupling the cover 60 into the cup 41, so as to be pressed between the bottom surface of the cup 41 and the inner surface of the cover 60, such as shown in FIG. 5.

Figure 5:
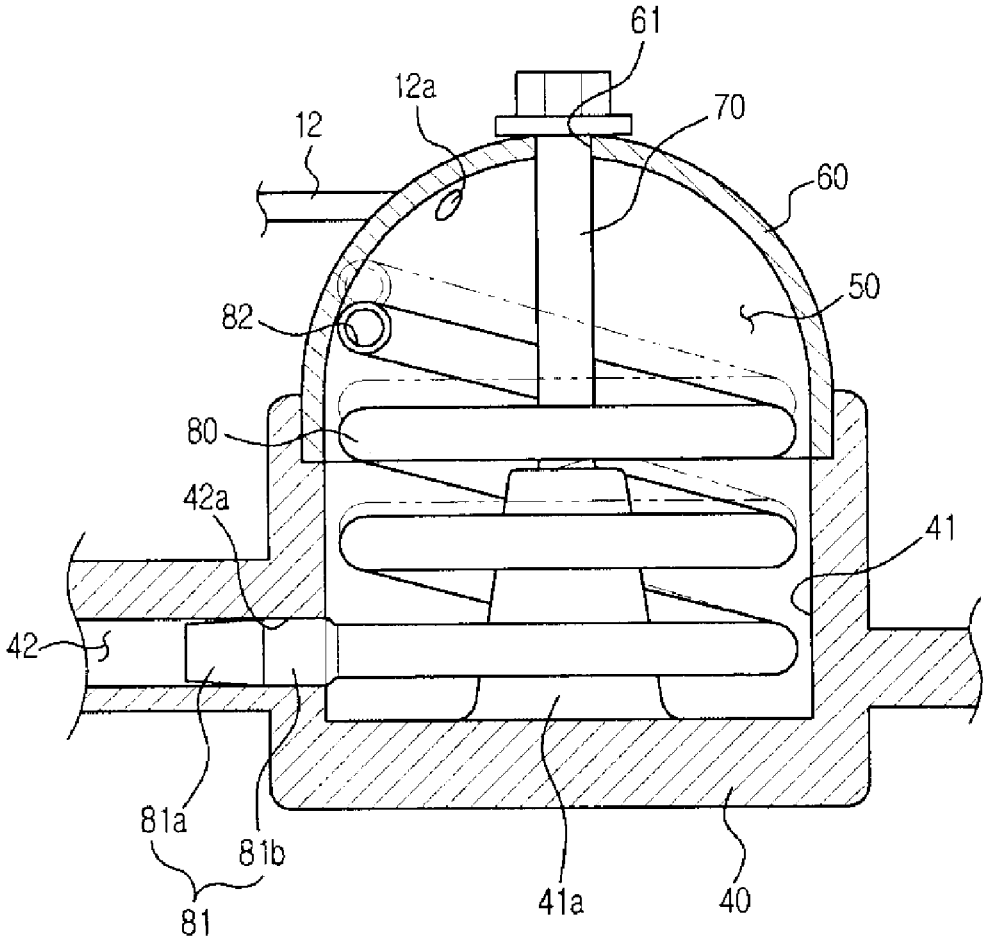
FIG. 5 is a sectional elevational view illustrating an assembled state of the damping discharge chamber of the hermetic compressor in accordance with an exemplary embodiment of the present invention.

Specifically, referring to FIG. 5, the exit end 42*a* of the discharge guide path 42 may be formed at one side of the bottom surface of the cup 41. The extension tube 80, which is coupled at the entrance end 81 thereof to the exit end 42*a* of the discharge guide path 42, may be bent to have a coil form extending from the bottom surface of the cup 41 toward the cover 60 while surrounding the boss 41*a* and the fixing bolt 70. The extension tube 80 may be configured to have a longer axial length than a distance between the bottom surface of the cup 50 and the cover 60 when it is not pressed. Accordingly, in the course of coupling the cover 60 into the cup 41, the extension tube 80 can be pushed or compressed, from the exit end 82 thereof, to the inner surface of the cover 60, thereby being pressed between the bottom surface of the cup 41 and the inner surface of the cover 60.

The extension tube 80, pressed between the bottom surface of the cup 41 and the inner surface of the cover 60, can absorb vibration caused during guidance of the refrigerant to be discharged, and the exit end 82 can be supported by the inner surface of the cover 60. As a result, the extension tube 80 can be supported at a fixed position in the damping discharge chamber 50 without causing excessive movement thereof.

As apparent from the above description, the present invention provides a hermetic compressor, in which a damping discharge chamber is connected with a refrigerant discharge chamber formed in a cylinder head through a discharge guide path formed in a frame. An extension tube may be provided in the damping discharge chamber to provide additional distance to the discharge guide path for the refrigerant to pass through. An entrance end of the extension tube may be connected to an exit end of the discharge guide path and an exit end of the extension tube being spaced apart from an entrance end of a discharge pipe that is connected to the damping discharge chamber.

Accordingly, in the hermetic compressor in accordance with the present invention, even if the discharge guide path formed in the frame is not long, a refrigerant guided from the refrigerant discharge chamber into the damping discharge chamber can achieve a long flow distance by virtue of the extension tube provided in the damping discharge chamber. As a results the damping discharge chamber provides reduction in pulsation of the refrigerant to be discharged more efficiently than prior art damping discharge chambers.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A hermetic compressor comprising of:

a frame;

a cylinder provided at one side of the frame and having a compression chamber;

a cylinder head coupled to the cylinder so as configured to hermetically seal the compression chamber and having a refrigerant discharge chamber to receive a refrigerant discharged from the compression chamber;

a damping discharge chamber provided at the other side of the frame configured to reduce pressure pulsation of the refrigerant having passed through the refrigerant discharge chamber;

a discharge guide path formed in the frame connecting the refrigerant discharge chamber and the damping discharge chamber;

a discharge pipe having an entrance end connected to the damping discharge chamber so as to guide the refrigerant, having passed through the damping discharge chamber, to outside of the hermetic compressor; and a compressible extension tube provided in the damping discharge chamber, having an entrance end connected to an exit end of the discharge guide path and an exit end of the extension tube being spaced apart from an entrance end of the discharge pipe and being pressed against an inner surface of the damping discharge chamber to compress the extension tube in the damping discharge chamber, and at least a portion of the extension tube being bendable.

2. The compressor according to claim 1, wherein the at least a portion of the extension tube is bent to have a coil form.

3. The compressor according to claim 1, wherein the damping discharge chamber includes a cup formed in the frame having an open end, and a cover to cover the open end of the cup, and wherein the extension tube is compressed between a bottom surface of the cup and an inner surface of the cover.

4. The compressor according to claim 3, wherein substantially the entire extension tube is bent to have a coil form.

5. The compressor according to claim 3, wherein the exit end of the discharge guide path is formed at one side of a bottom surface of the cup.

6. The compressor according to claim 1, wherein the entrance end of the extension tube is forcibly press-fitted into the exit end of the discharge guide path.

7. A damping discharge chamber for a hermetic compressor, comprising:

a cup having a bottom portion, an open end, and a first opening for receiving refrigerant;

a cover for covering the open end of the cup, having an inner surface and a second opening for discharging the refrigerant;

a compressible extension tube being bent in a coil form and disposed inside the cup and the cover, having an entrance end inserted in the first opening of the cup, and an exit end pressing against an inner wall of the cover thereby compressing the extension tube between the cup and the cover.

8. The damping discharge chamber of claim 7, wherein the exit end of the extension tube is spaced apart from the second opening of the cover.

9. The damping discharge chamber of claim 7, wherein the extension tube is made of metal.

10. The damping discharge chamber of claim 9, wherein the metal is aluminum.

11. The damping discharge chamber of claim 7, further comprising:

a bolt;

the bottom portion of the cup comprising a boss; and the cover further comprising a hole;

wherein the bolt is inserted through the hole of the cover and fastened to the boss.

12. The damping discharge chamber of claim 7, wherein the first opening of the cup is coupled to a discharge guide path for receiving the refrigerant from a refrigerant discharge chamber in the hermetic compressor, and wherein the second opening of the cover is coupled to a discharge pipe for discharging the refrigerant, having passed through the damping discharge chamber, to outside of the hermetic compressor.

* * * * *